US006679157B2

(12) United States Patent
Chu et al.

(10) Patent No.: US 6,679,157 B2
(45) Date of Patent: Jan. 20, 2004

(54) LIGHTWEIGHT ARMOR SYSTEM AND PROCESS FOR PRODUCING THE SAME

(75) Inventors: Henry S. Chu, Idaho Falls, ID (US); H. Alan Bruck, Wheaton, MD (US); Gary C. Strempek, Milford, MA (US); Dominic J. Varacalle, Jr., Idaho Falls, ID (US)

(73) Assignee: Bechtel BWXT Idaho LLC, Idaho Falls, ID (US)

( * ) Notice: Subject to any disclaimer, the term of this patent is extended or adjusted under 35 U.S.C. 154(b) by 64 days.

(21) Appl. No.: 10/053,852

(22) Filed: Jan. 18, 2002

(65) Prior Publication Data

US 2002/0088340 A1 Jul. 11, 2002

Related U.S. Application Data

(63) Continuation of application No. 09/409,537, filed on Sep. 30, 1999, now abandoned.

(51) Int. Cl.[7] ..... F41H 5/02
(52) U.S. Cl. ..... 89/36.02; 428/539.5; 428/548
(58) Field of Search ..... 89/36.02; 428/632, 428/539.5, 548

(56) References Cited

U.S. PATENT DOCUMENTS

| | | | | | |
|---|---|---|---|---|---|
| 3,633,520 | A | | 1/1972 | Stiglich | 109/82 |
| 3,802,850 | A | | 4/1974 | Clougherty | 29/182.2 |
| 3,804,034 | A | * | 4/1974 | Stiglich, Jr. | 428/547 |
| 4,503,130 | A | | 3/1985 | Bosshart et al. | 428/632 |
| 4,588,607 | A | | 5/1986 | Matarese et al. | 427/34 |
| 4,778,649 | A | * | 10/1988 | Niino et al. | 419/9 |
| 5,035,923 | A | | 7/1991 | Sarin | 427/255 |
| 5,211,991 | A | | 5/1993 | Bullock | 427/448 |
| 5,443,892 | A | * | 8/1995 | Holcombe et al. | 428/216 |
| 5,705,283 | A | | 1/1998 | Upadhya | 428/610 |
| 5,716,422 | A | | 2/1998 | Muffoletto et al. | 29/623.5 |
| 5,837,326 | A | | 11/1998 | Dallaire et al. | 427/449 |
| 5,939,146 | A | | 8/1999 | Lavernia | 427/446 |
| 5,980,604 | A | | 11/1999 | Lavernia | 75/338 |
| 5,988,488 | A | | 11/1999 | Slattery et al. | 228/262.6 |
| 6,048,586 | A | | 4/2000 | Burris et al. | 427/446 |
| 6,089,444 | A | * | 7/2000 | Slattery et al. | 228/194 |

* cited by examiner

*Primary Examiner*—Harold J. Tudor
*Assistant Examiner*—Troy Chambers
(74) *Attorney, Agent, or Firm*—Dahl & Osterloth LLP

(57) ABSTRACT

A lightweight armor system may comprise a substrate having a graded metal matrix composite layer formed thereon by thermal spray deposition. The graded metal matrix composite layer comprises an increasing volume fraction of ceramic particles imbedded in a decreasing volume fraction of a metal matrix as a function of a thickness of the graded metal matrix composite layer. A ceramic impact layer is affixed to the graded metal matrix composite layer.

30 Claims, 3 Drawing Sheets

LIGHTWEIGHT ARMOR SYSTEM AND PROCESS FOR PRODUCING THE SAME

CROSS-REFERENCE TO RELATED APPLICATION

This is a continuation of U.S. patent application Ser. No. 09/409,537, filed on Sep. 30, 1999, now abandoned, which is hereby incorporated herein by reference for all that it discloses.

CONTRACTUAL ORIGIN OF THE INVENTION

The United States Government has rights in this invention pursuant to Contract No. DE-AC07-94ID13223 between the U.S. Department of Energy and Lockheed Martin Idaho Technologies Company, now Contract No. DE-AC07-99ID13727 between the U.S. Department of Energy and Bechtel BWXT Idaho, LLC.

FIELD OF INVENTION

The present invention relates to armor systems in general and more specifically to a light weight armor system having a functionally graded cermet interlayer.

BACKGROUND

Many different kinds of lightweight armor systems are known and are currently being used in a wide range of applications, including, for example, aircraft, light armored vehicles, and body armor systems, wherein it is desirable to provide protection against bullets and other projectiles. While early armor systems tended to rely on a single layer of a hard and brittle material, such as a ceramic material, it was soon realized that the effectiveness of the armor system could be improved considerably if the ceramic material were affixed to or "backed up" with an energy absorbing material, such as fiberglass. The presence of the energy absorbing backup layer tends to reduce the spallation caused by impact of the projectile with the ceramic material or "impact layer" of the armor system, thereby reducing the damage caused by the projectile impact. Testing has demonstrated that such multi-layer armor systems tend to stop projectiles at higher velocities than do the ceramic materials when utilized without the backup layer.

While such multi-layer armoring systems are being used with some degree of success, they are not without their problems. For example, difficulties are often encountered in creating a multi-layer structure having both sufficient mechanical strength as well as sufficient bond strength.

Partly in an effort to solve the foregoing problems, armor systems have been developed in which a "graded" ceramic material having a gradually increasing dynamic tensile strength and energy absorbing capacity is sandwiched between the impact layer and the backup material. An example of such an armor system is disclosed in U.S. Pat. No. 3,633,520 issued to Stiglich and entitled "Gradient Armor System," which is incorporated herein by reference for all that it discloses. The armor system disclosed in the foregoing patent comprises a ceramic impact layer that is backed by an energy absorbing ceramic matrix having a gradient of fine metallic particles dispersed therein in an amount from about 0% commencing at the front or impact surface of the armor system to about 0.5 to 50% by volume at the backup material. The armor system may be fabricated by positioning successive layers of powder mixtures comprising the appropriate volume ratios of ceramic and metallic materials in a graphite die and onto a graphite bottom plunger. A top plunger is placed in the die in contact with the powder layers and the entire assembly is thereafter placed within an induction coil. Power is applied to the induction coil to heat the powder and die. Substantial pressure (e.g., about 8,000 psi) is then applied to the die to sinter the powder material and form the gradient armor system.

While the foregoing type of armor system was promising in terms of performance, the powder metallurgy process used to form the graded composite layers proved difficult to implement in practice. Consequently, such armor systems have never been produced on a large scale basis.

SUMMARY OF THE INVENTION

A lightweight armor system according to the present invention may comprise a substrate having a graded metal matrix composite layer formed thereon by thermal spray deposition. The graded metal matrix composite layer comprises an increasing volume fraction of ceramic particles imbedded in a decreasing volume fraction of a metal matrix as a function of a thickness of the graded metal matrix composite layer. A ceramic impact layer is affixed to the graded metal matrix composite layer.

A process for producing a lightweight armor system may comprise the steps of: Depositing by thermal spray deposition a graded metal matrix composite layer on a substrate, the graded metal matrix composite layer comprising an increasing volume fraction of ceramic particles imbedded in a decreasing volume fraction of a metal matrix with increasing thickness of the graded metal matrix composite layer; and affixing a ceramic impact layer to the graded metal matrix composite layer.

BRIEF DESCRIPTION OF THE DRAWING

Illustrative and presently preferred embodiments of the invention are shown in the accompanying drawing in which.

DETAILED DESCRIPTION OF THE INVENTION

Figure 1:
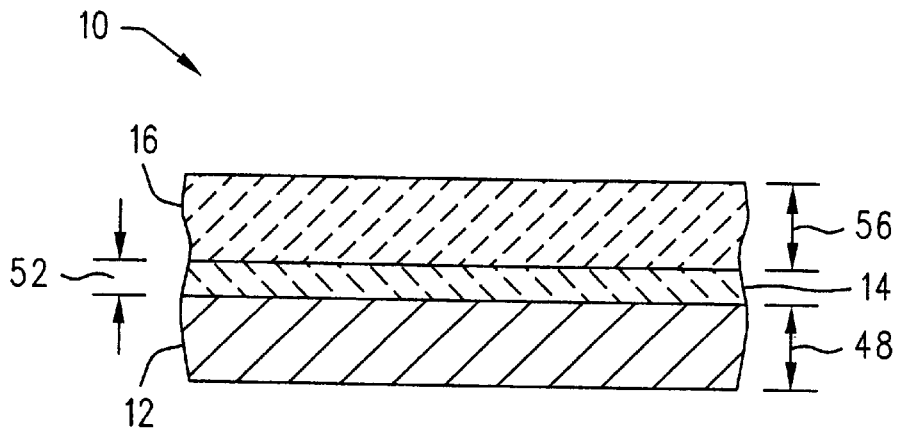
FIG. 1 is a cross section view in elevation of a lightweight armor system produced according to the process of the present invention showing the substrate, the graded metal matrix composite layer, and the impact layer.
Figure 2:
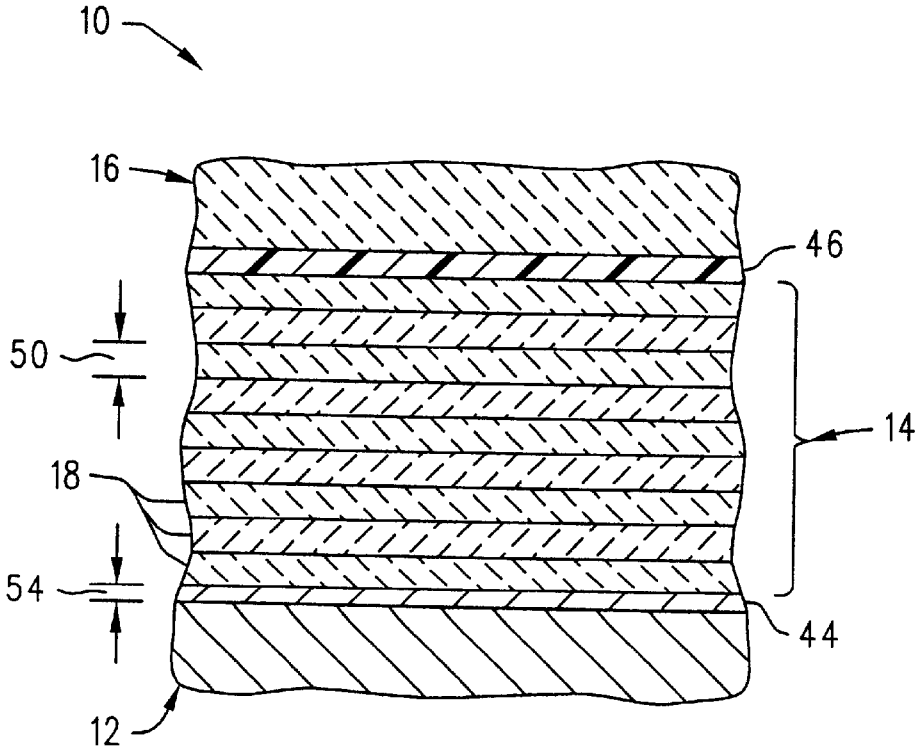
FIG. 2 is an enlarged cross-section view in elevation of the graded metal matrix composite layer shown in FIG. 1.

A lightweight armor system 10 according to the present invention is best seen in FIGS. 1 and 2 and may comprise a multi-layer configuration having a substrate 12, a graded metal matrix composite layer 14, and an impact layer 16. As will be described in greater detail below, the substrate 12 may comprise a generally ductile metallic material (e.g., aluminum), whereas the impact layer 16 may comprise a generally hard material having a high compressive strength, such as a ceramic material.

The graded metal matrix composite layer 14 is best seen in FIG. 2 and may comprise a plurality of cermet (i.e., ceramic/metallic) layers 18, each of which comprises a different ratio, on a volume basis, of ceramic and metallic materials. For example, in the embodiment shown and described herein, the graded metal matrix composite layer 14 comprises an increasing volume fraction of ceramic particles (e.g., alumina) imbedded in a decreasing volume fraction of a metal matrix (e.g., aluminum) with increasing thickness of the graded metal matrix composite layer 14. Stated another way, the first cermet layer 18 (i.e., the layer immediately adjacent the substrate 12) comprises a relatively large percentage (e.g., about 90% on a volume basis) of the metallic material, with only a small percentage (e.g., about 10%) of the ceramic material. The ceramic component of each successive cermet layer 18 is gradually increased so that the top or outermost cermet layer 18 comprises primarily the ceramic component (e.g., about 90% by volume) with only a small percentage (e.g., about 10% by volume) of the metallic component.

As will be discussed in greater detail below, the graded metal matrix composite interlayer 14 may be deposited on the substrate 12 by a thermal spray deposition process. As used herein, the terms "thermal spray deposition" and "thermal spray deposition process" shall mean any coating process wherein the material to be deposited is heated to near or above its melting point and accelerated toward the substrate by a plasma jet, a high velocity combustion gas stream, or by a detonation wave.

Figure 3:
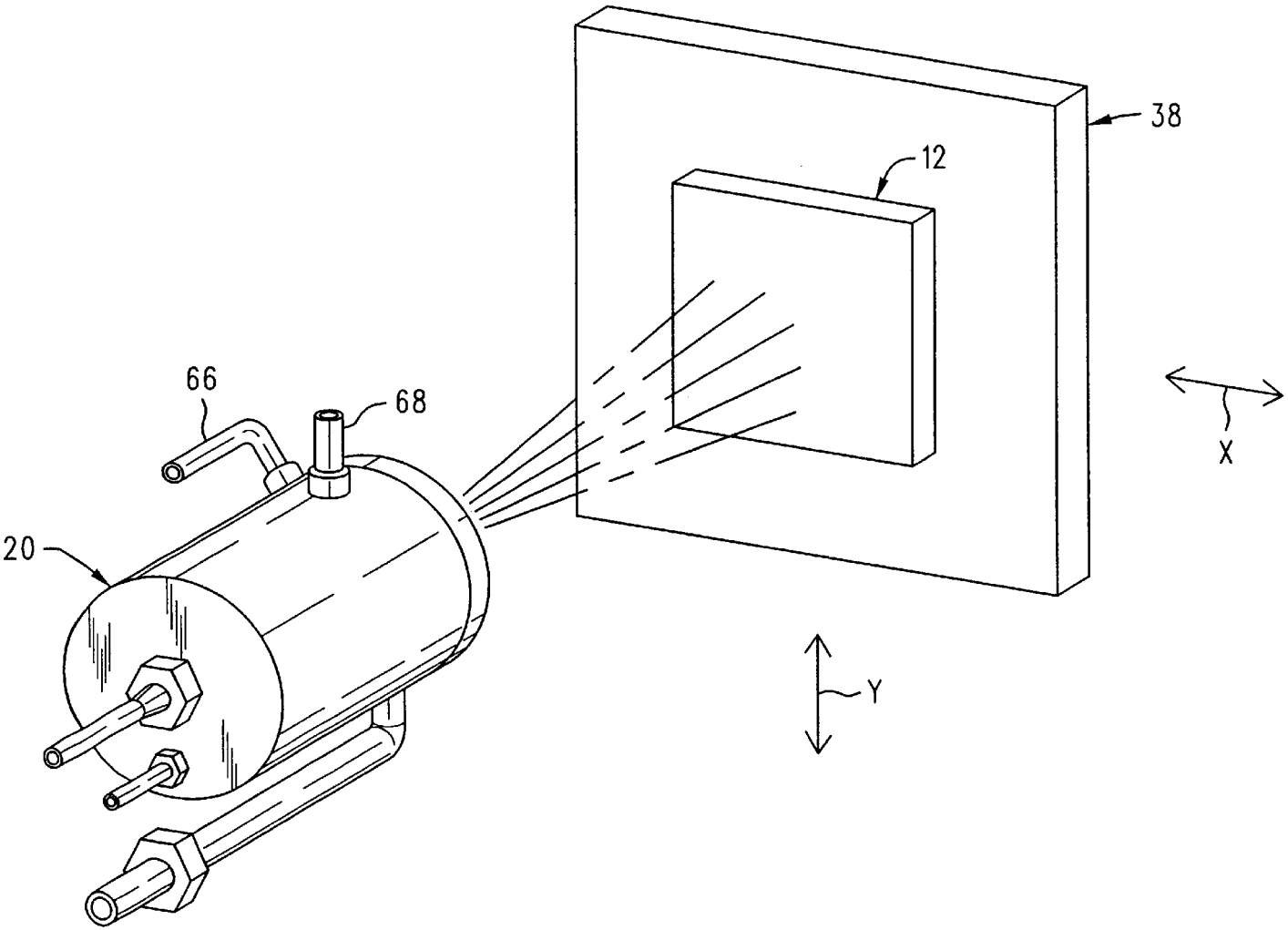
FIG. 3 is a perspective view of a thermal spray gun and substrate support system which may be used to deposit the graded metal matrix composite layer on the substrate.
Figure 4:
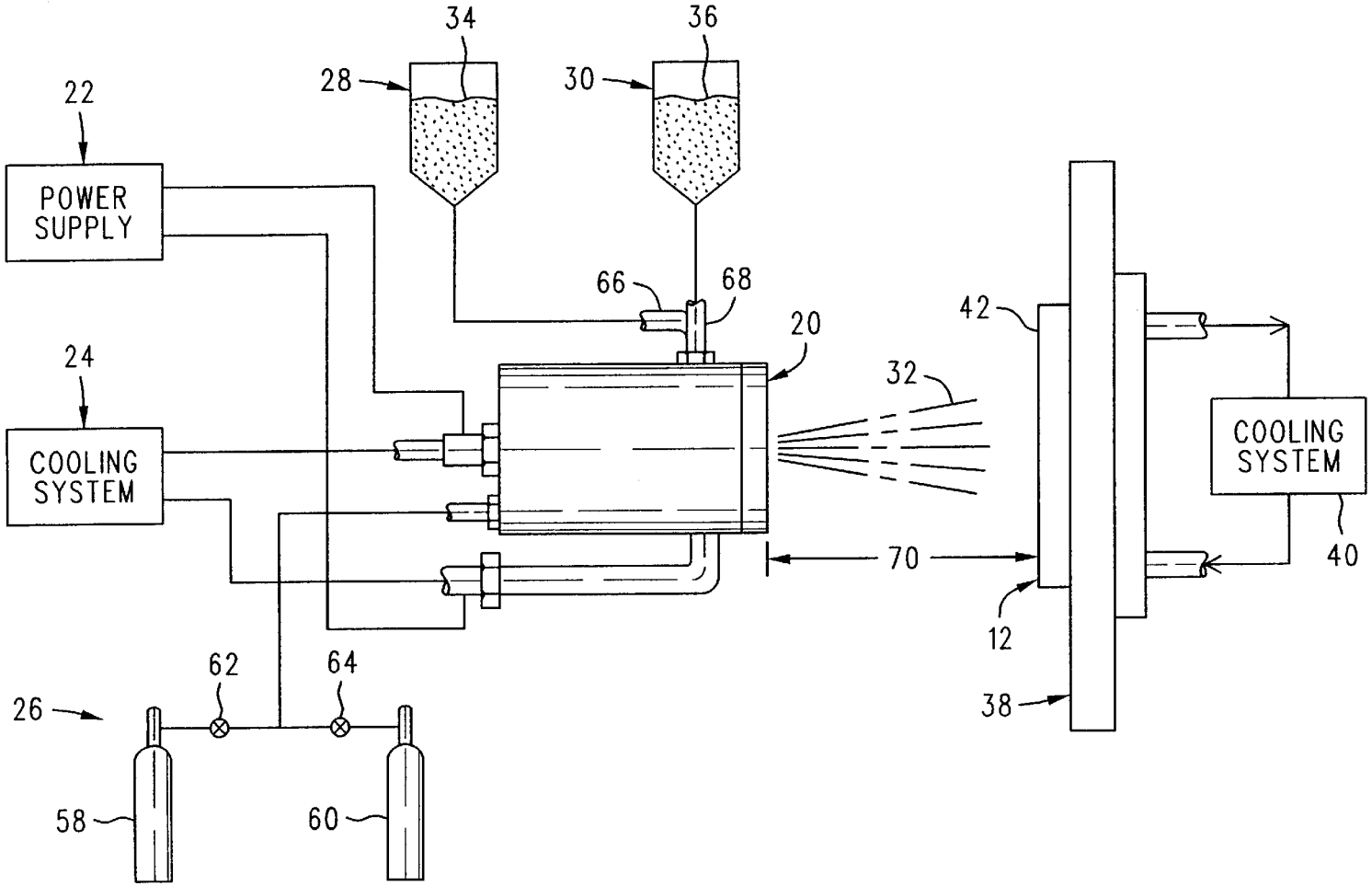
FIG. 4 is a side view in elevation of the thermal spray gun and substrate support system shown in FIG. 3.

Referring now to FIGS. 3 and 4, the various cermet layers 18 comprising the graded metal matrix composite layer 14 may be deposited by a thermal spray gun 20 of the type that is readily commercially available. As will be described in greater detail below, the thermal spray gun 20 may be provided with a variety of ancillary components and devices to allow the graded metal matrix composite layer 14 to be deposited by the process according to the present invention. For example, in one preferred embodiment, such ancillary components and devices may comprise a power supply 22, a cooling system 24, and a process gas supply system 26. The power supply 22 provides electrical power to the thermal spray gun 20, whereas the cooling system 24 cools the thermal spray gun 20 to prevent it from overheating. The process gas supply system 26 provides one or more process gases to the thermal spray gun 20. The thermal spray gun 20 may also be connected to one or more particle hoppers or powder feeders 28 and 30 which contain, in the form of a finely divided powder, the material 34, 36 to be deposited on the substrate 12. For example, in the embodiment shown and described herein, the material 34 and 36 may comprise a mixture of aluminum and alumina powders.

When supplied with electrical power and a process gas or gases (e.g., argon, helium, or a mixture thereof), the thermal spray gun 20 produces a high temperature, high velocity plasma jet 32. The material (e.g., 34, 36) contained in the hopper or hoppers (e.g., 28 and 30) and that is to be deposited on the substrate 12 is fed into the plasma jet 32 by a suitable material supply port or ports (not shown) internal to the thermal spray gun 20. The plasma jet 32 heats the material (e.g., 34, 36) and accelerates it toward the substrate 12. The material thereafter impacts the substrate 12 and forms a coating.

In the embodiment shown and described herein, the substrate 12 is mounted to a substrate support system 38 which moves the substrate along the X and Y axes (FIG. 3) to allow the material (e.g., 34, 36) to be distributed more evenly over the front surface 42 of the substrate 12. As will be described in greater detail below, the substrate support system 38 may be provided with a cooling system 40 (FIG. 4) to prevent the substrate 12 from being heated to excessive temperatures by the plasma jet 32.

The lightweight armor system 10 according to the present invention may be fabricated according to the following process. As a first step in the process, a suitable substrate 12 is selected and mounted to the substrate support system 38 so that the substrate 12 is securely held thereby. While any of a wide range of materials may be used, in one preferred embodiment, the substrate 12 may comprise an aluminum alloy, such as 6061T6 aluminum alloy. In most cases it will be necessary, or at least desirable, to first clean and prime (i.e., deposit a bond coat thereon) the front surface 42 of the substrate 12 to ensure better adhesion of the of the graded metal matrix composite layer 14. For example, the front surface 42 of substrate 12 first may be chemically cleaned and then roughened by blasting the front surface 42 with a suitable abrasive material, such as alumina or steel grit. The abrasive material removes any residual foreign matter from the surface 42 of the substrate 12 and slightly roughens the surface 42, thereby improving the adhesion of the bond coat.

Once the grit blasting process is complete, the front surface 42 of the substrate 12 may be conditioned or "primed" by depositing thereon a thin primer layer or bond coat 44 (FIG. 2). The bond coat 44 improves the adhesion of the graded metal matrix composite layer 14 to the substrate 12. As will be described in greater detail below, the bond coat 44 may comprise any of a wide range of metals and metal alloys. By way of example, in one preferred embodiment, the primer layer 44 may comprise a nickel-aluminum alloy. The primer layer or bond coat 44 may be deposited by thermal spray deposition, although other processes (e.g., sputtering) may also be used.

After the front surface 42 of the substrate 12 has been suitably prepared, i.e., grit blasted and bond coated (i.e., primed) as described above, the first cermet layer 18 (FIG. 2) comprising the graded metal matrix composite layer 14 may be deposited thereon. Generally speaking, it will be desirable to pre-heat the substrate 12 before the first cermet layer 18 is deposited. In the embodiment shown and described herein, the substrate 12 may be suitably pre-heated by the thermal spray deposition process that is used to deposit the bond coat 44. Alternatively, other methods may be used to pre-heat the substrate 12 if a long time has passed since the deposition of the bond coat 44. For example, the substrate 12 may be pre-heated by the hot plasma jet produced by the thermal spray gun. As was described above, the first cermet layer 18 should comprise a relatively high percentage (e.g., about 90% on a volume basis) of the metal matrix material and a relatively low percentage (e.g., about 10% on a volume basis) of ceramic material. Such a graded composition may be achieved by pre-mixing the appropriate proportions of metal and ceramic powder and then by loading the mixture into one of the powder feeders or hoppers (e.g., 28, 30) connected to the thermal spray gun 20. In the embodiment shown and described herein, a mixture comprising about 90% by volume of aluminum powder and about 10% by volume alumina ($Al_1O_3$) powder may be loaded into the first powder feeder or hopper 28. The mixture may then be deposited onto the front surface 42 (actually onto the primer layer or bond coat 44) of the substrate 12 by the thermal spray gun 20.

The second cermet layer 18 may be deposited in essentially the same way as the first cermet layer 18, except that the material comprising the second cermet layer 18 should comprise a somewhat lesser percentage (by volume) of aluminum powder (e.g., about 80%) and a somewhat greater percentage of alumina powder (e.g., 20%). A powder mixture comprising the foregoing volume percentage ratios may be premixed and loaded into the second powder feeder or hopper 30 connected to the thermal spray gun 20.

Accordingly, the second cermet layer 18 may be deposited immediately following the deposition of the first cermet layer 18 by simply changing the powder feeder or hopper from which the material is drawn, e.g., by changing the powder feed from hopper 28 to hopper 30.

The subsequent cermet layers 18 may be deposited in essentially the same manner as the first two cermet layers 18 just described (i.e., in groups of two cermet layers 18 in succession) by providing the appropriate powder mixtures to the powder feeders 28 and 30. In one preferred embodiment, the final (i.e., outermost) cermet layer 18 may comprise a mixture of about 90% alumina and about 10% aluminum by volume.

After the final cermet layer 18 comprising the graded metal matrix composite layer 14 has been deposited on the substrate 12, the ceramic impact layer 16 may be affixed to the graded metal matrix composite layer 14. By way of example, in one preferred embodiment, the ceramic impact layer 16 comprises a substantially pure alumina plate or "tile" and may be affixed to the graded metal matrix composite layer 14 by any of a wide range of suitable adhesives (FIG. 2), such as by a polyurethane adhesive 46. Alternatively, the ceramic impact layer 16 may be deposited on the graded metal matrix composite layer 14, such as by spraying.

A significant advantage of the lightweight armor system 10 according to the present invention is that the various layers (e.g., 12, 14, and 16) thereof comprise different materials which have different properties to increase the overall effectiveness of the armor system. For example, the ceramic impact layer or face 16 has a high compressive strength and acoustic impedance, thus making it ideal for the hard, projectile-shattering medium that comprises the impact layer 16. The metal matrix composite interlayer 14 mechanically constrains (i.e., supports) the ceramic impact layer or face 16. The mechanical support provided by the metal matrix composite interlayer 14 delays the onset of shattering of the impact layer 16 that occurs on projectile impact. The delayed shattering of the impact layer 16 improves the performance of the armor system 10. The metal matrix composite interlayer 14 also dissipates or attenuates the stress wave (not shown) produced by the projectile impact. The energy dissipation function is enhanced by the variable ratio (i.e., graded composition) of ceramic material to metal material in the composite interlayer 14. That is, the outer cermet layers (i.e., those layers having a larger percentage of ceramic material) are generally harder than the inner cermet layers, which tend to be more ductile, yet possess greater dynamic strength. These differing material properties tend to absorb or attenuate the shock wave more effectively than is generally possible with a material that has uniform material properties throughout. The metallic substrate 12 provides structural support for the metal matrix composite interlayer 14 and ceramic impact layer 16. The ductile nature of the metallic substrate 12 also improves the dissipation of any remaining impact energy. Also, when the lightweight armor system 10 is deflected by projectile impact, the graded composition of the lightweight armor system 10 causes the neutral axis (not shown) of the armor system 10 to be shifted or moved toward the more ductile layers of the armor system 10. This movement of the neutral axis under load further enhances the performance of the lightweight armor system 10.

Still other advantages are associated with the process for fabricating the lightweight armor system 10. For example, the thermal spray deposition process used to deposit the various cermet layers 18 comprising the graded metal matrix composite layer 14 allows the cermet layers 18 to be rapidly deposited on substrates having relatively large surface areas. The thermal spray deposition process may also be performed with equipment and devices that are readily commercially available, thereby dispensing with the need to provide special equipment and devices (e.g., large-capacity hot presses) to produce the armor system.

Having described the lightweight armor system 10 and process for fabricating the same, as well as some of their more significant features and advantages, the lightweight armor system 10 and fabrication process will now be described in detail. Referring back now to FIGS. 1 and 2, the lightweight armor system 10 according to one embodiment of the present invention may comprise a substrate 12 on which is provided a graded metal matrix composite layer 14 and an impact layer 16. Each of the layers will now be described in detail.

The substrate 12 may comprise a metallic structure or fibrous laminate structure in any of a wide variety of forms (e.g., plate, shell, or cylinder), depending on the particular application. The substrate 12 should have a good balance of low specific gravity (i.e., density), high structural stiffness, high toughness, and high mechanical strength. One other factor that is of importance is the compatibility of the substrate 12 with the material that makes up the cermet layer 18.

Certain of the foregoing factors may be more or less important depending on the particular application, as would be obvious to persons having ordinary skill in the art after having become familiar with the teachings of the present invention. For example, if the armor is to be applied over a vehicle body, then it will generally not be necessary to ensure that the substrate 12 provides a high structural stiffness. However, if the armor is to be used as body armor, then it will generally be advantageous to provide a substrate having a high structural stiffness in order to minimize the deflection of the armor that will occur due to projectile impact. On balance, we have discovered that aluminum and its various alloys are suitable for the substrate 12. By way of example, in one preferred embodiment, the substrate 12 is fabricated from 6061T6 aluminum, although other alloys could also be used.

The thickness 48 (FIG. 1) of the substrate 12 should be selected so that the substrate 12 will provide sufficient mechanical support for the graded metal matrix composite layer 14 and impact layer 16, as well as provide sufficient strength to allow the lightweight armor system 10 to stop projectiles having given properties and impact velocities. By way of example, in one preferred embodiment, the substrate 12 may have a thickness 48 in the range of about 0.125 inches to about 0.50 inches (0.25 inches preferred). Alternatively, other thicknesses could be used depending on the particular application and desired performance envelope of the lightweight armor system, as would be obvious to persons having ordinary skill in the art after having become familiar with the teachings of the present invention.

Referring now primarily to FIG. 2, the graded metal matrix composite layer 14 may comprise a plurality of cermet (i.e., ceramic/metallic) layers 18, each of which comprises a different volume ratio of ceramic and metallic materials. For example, in the embodiment shown and described herein, each subsequent cermet layer 18 comprises an increasing volume fraction of the ceramic material imbedded in a decreasing volume fraction of the metallic material. Put in other words, the first cermet layer 18 (i.e., the layer immediately adjacent the substrate 12) comprises a relatively large percentage of the metallic material in which is dispersed a relatively small percentage of the ceramic material. The percentage of the ceramic material that is dispersed in the metallic material is gradually increased with each successive cermet layer 18 so that the top or outermost cermet layer 18 comprises primarily the ceramic material with only a small percentage of the metallic material dispersed therein.

The metallic and ceramic materials comprising each cermet layer 18 may be selected from any of a wide range of metallic and ceramic materials well-known in the art and that are readily commercially available. Consequently, the present invention should not be regarded as limited to any particular material or combination of materials. By way of example, in one preferred embodiment, the metallic material comprises aluminum, whereas the ceramic material comprises alumina ($Al_2O_3$).

As mentioned above, the ceramic and metallic materials are deposited on the substrate 12 so that each successive cermet layer 18 comprises an increasing percentage (on a volume basis) of the ceramic material dispersed in an ever decreasing percentage of the metallic material. While the particular percentage ratios for any given cermet layer 18 is not particularly important, it is important that each successive cermet layer 18 comprise an increasing proportion of the ceramic material. Consequently, the present invention should not be regarded as limited to cermet layers 18 having any particular proportion of ceramic and metallic components, so long as the outer layers comprise a greater percentage of the ceramic component. Similarly, particular number of individual cermet layers 18 that make up the graded metal matrix composite layer 14 is also not particularly critical. However, we have found that the graded metal matrix composite layer 14 should comprise no fewer than four (4) cermet layers 18. The provision of at least four (4) cermet layers 18 provides a good compositional gradient and reduces the likelihood that the layers will separate due to the differences in thermal expansion coefficients between the various layers. That is, if fewer than four (4) cermet layers 18 are provided, the thermal stresses associated with the different thermal expansion coefficients of each layer generally precludes the formation of a strong bond between the various cermet layers 18. With the foregoing considerations in mind, it is generally preferred that the metal matrix composite layer 14 may comprise from about 4 to about 12 cermet layers 18, with nine (9) separate cermet layers 18 being preferred.

In the case where the metal matrix composite layer 14 comprises nine (9) separate cermet layers 18, the first cermet layer 18 may comprise, on a volume basis, about 90% aluminum and about 10% alumina. The volume percentage of alumina is increased by 10 with each successive cermet layer 18. Accordingly, the second cermet layer 18 may comprise about 20% alumina (by volume) dispersed in about 80% aluminum; the third cermet layer 18, about 30% alumina in about 70% aluminum, and so on, with the final or outermost cermet layer 18 comprising about 90% alumina and about 10% aluminum. The foregoing volume ratios may be achieved by mixing aluminum and alumina powders in the appropriate volume ratios and thereafter depositing the powder mixture on the substrate 12 according to the thermal spray deposition process that will be described below.

Each cermet layer 18 may have a thickness 50 so that the overall thickness 52 of the graded metal matrix composite interlayer 14 is sufficient to provide the adequate dissipation or absorption of the shock wave (not shown) produced by the impact of a projectile on the impact layer 16 of the lightweight armor system 10. The thickness 50 of each cermet layer 50 should also be sufficient to prevent cracking or de-bonding of the layers 50. As was the case for the substrate 12, the thickness 50 of each cermet layer 18 will depend on the particular application and desired performance of the lightweight armor system 10. Consequently, the present invention should not be regarded as limited to cermet layers 18 having any particular thickness 50, nor to the graded metal matrix composite interlayer 14 having any particular overall thickness 52. By way of example, in one preferred embodiment, each cermet layer 18 has a thickness 50 in the range of about 0.010 inches to about 0.050 inches (about 0.010 inches preferred). Accordingly, in the embodiment shown and described herein wherein the graded metal matrix composite interlayer 14 comprises nine (9) individual cermet layers 18, the overall thickness 52 of the graded metal matrix composite interlayer 14 may be in the range of about 0.040 inches to about 0.450 inches (0.090 inches preferred).

While the various cermet layers 18 that comprise the graded metal matrix composite layer 14 may be deposited directly on the front side 42 (FIGS. 3 and 4) of the substrate 12, we have found it advantageous to first deposit a thin primer layer or bond coat 44 on the front surface 42 of substrate 12. The primer layer or bond coat 44 improves the adhesion of the first cermet layer 18 to the substrate 12 and also serves as a buffer for the differences in the coefficients of thermal expansion between the two layers. The bond coat 44 may comprise any of a wide range of metals and metal alloys chemically suitable for the particular composition of the cermet layers 18. Consequently, the present invention should not be regarded as limited to a bond coat 44 comprising any particular material. However, by way of example, in one preferred embodiment, the bond coat 44 may comprise a nickel-aluminum alloy that may be deposited on the front side 42 of the substrate 12 by thermal spraying, although other deposition techniques (e.g., sputtering) may also be used.

The thickness 54 of the bond coat 44 is not particularly critical and need only be sufficient to thoroughly cover or coat the front surface 42 of substrate 12. By way of example, in one preferred embodiment, the bond coat 44 may have a thickness 54 in the range of about 0.001 inches to about 0.010 inches (0.003 inches preferred), although other thicknesses may also be used.

Referring back now to FIG. 1, the impact layer 16 may comprise a material having a high hardness, acoustic impedance, and compressive strength, while at the same time having a low specific gravity to minimize the overall weight of the armor system 10. Generally speaking, ceramic materials, such as alumina ($Al_2O_3$), silicon carbide (SiC), and boron carbide ($B_4C$), will be suitable for use as the impact layer 16. By way of example, in one preferred embodiment, the impact layer 16 comprises an alumina plate or tile of the type available from Coors Ceramics, Inc., of Golden Colo., as product type AD-85.

The thickness 56 (FIG. 1) of the impact layer 16 should be selected so that the impact layer 16 provides sufficient strength and acoustic impedance to shatter the anticipated type of impacting projectile. By way of example, in one preferred embodiment, the impact layer 16 may have a thickness 56 in the range of about 0.125 inches to about 1.0 inches (0.25 inches preferred). Alternatively, other thicknesses could be used depending on the particular application and desired performance envelope of the lightweight armor system 10, as would be obvious to persons having ordinary skill in the art after having become familiar with the teachings of the present invention.

The impact layer 16 may be secured to the graded metal matrix composite layer 14 by any of a wide range of adhesives suitable for bonding ceramic materials that are well-known in the art and readily commercially available. Consequently, the present invention should not be regarded as limited to any particular adhesive material. By way of example, in the embodiment shown and described herein, the impact layer 16 is secured to the graded metal matrix composite layer 14 by a polyurethane adhesive 46, such as Uralite® 3501, available from Hexcel Corporation of Chatsworth, Calif.

The various cermet layers 18 comprising the graded metal matrix composite layer 14 may be deposited by a thermal spray gun 20. The thermal spray gun 20 may comprise any of a wide variety of thermal spray guns that are well-known in the art and readily commercially available. Consequently, the present invention should not be regarded as limited to any particular type of thermal spray gun. However, by way of example, the thermal spray gun 20 utilized in one preferred embodiment of the present invention may comprise a Plasmadyne SG-100 plasma spray system available from Miller Thermal, Inc., of Appleton, Wis. Since thermal spray guns of the type that may be used in the present invention are well-known in the art and could be easily provided by persons having ordinary skill in the art after having become familiar with the teachings of the present invention, the thermal spray gun 20 that may be utilized in one preferred embodiment of the present invention will not be described in greater detail herein.

Referring now to FIGS. 3 and 4, the thermal spray gun 20 may be provided with a variety of ancillary systems and devices to allow the graded metal matrix composite layer 14 to be deposited by the process according to the present invention. In the embodiment shown and described herein, such ancillary systems and devices may comprise a power supply 22, a cooling system 24, and a process gas supply system 26. The power supply 22 supplies electrical power to the thermal spray gun 20 and, in the embodiment shown and described herein, is of sufficient capacity to provide 40–60 kilowatts (kw) of power to the gun 20 at currents ranging from about 700 to about 800 amperes. The cooling system 24 provides a suitable liquid coolant (e.g., water) to the thermal spray gun 20 to prevent the same from becoming overheated during operation. The process gas supply system 26 provides one or more process gases to the spray gun 20. In the embodiment shown and described herein, the process gas supply system 26 comprises a helium tank 58 for providing helium to the spray gun 20 as well as an argon tank 60 for providing argon to the spray gun 20. The process gas supply system 26 may also be provided with a pair of valves 62 and 64 to allow the ratio (on a volume flow rate basis) of helium to argon to be varied depending on the particular cermet layer that is to be deposited, as will be described in greater detail below.

The material to be deposited by the thermal spray gun 20 may be contained in one or more hoppers 28 and 30 that are connected to the thermal spray gun 20. For example, the thermal spray gun 20 utilized in one embodiment of the invention and that is identified specifically above includes a pair of particle inlets 66 and 68 which may be connected to hoppers 28 and 30, respectively. Alternatively, thermal spray guns having a greater or lesser number of separate particle inlets may also be used. As mentioned above, the material to be deposited by the thermal spray gun 20 is provided in powder form and is fed to the gun from the hoppers in a manner well-known in the art. For example, in the embodiment shown and described herein, a first material mixture 34 having metal and ceramic components according to a first volume ratio may be loaded into the first hopper 28, whereas a second mixture 36 having metal and ceramic components according to a second ratio may be loaded into the second hopper 30. The material 34 from the first hopper 28 may be used to deposit a first cermet layer 18 on the substrate 12, whereas the material 36 from the second hopper 30 may be used to deposit a second cermet layer 18 on the first cermet layer 18. Alternatively, spray guns providing only a single material hopper may also be used, as would be obvious to persons having ordinary skill in the art.

As was the case for the thermal spray gun 20, the various ancillary systems and devices (e.g., the power supply 22, cooling system 24, and process gas supply system 26) that may be used with such thermal spray guns are well-known in the art could be easily provided by persons having ordinary skill in the art after having become familiar with the teachings of the present invention. Accordingly, the ancillary systems and devices utilized in one preferred embodiment of the present invention will not be described in further detail herein.

It is generally preferred, but not required, to utilize a substrate support system 38 (FIG. 4), (e.g., a robotic manipulator system) that is moveable in both the X and Y directions (FIG. 3) to move the substrate 12 with respect to the thermal spray gun 20. The movement of the substrate support system 38 along the X and Y axes during the coating process improves the uniformity of the coating. In an alternative arrangement, the substrate 12 could be held stationary while the plasma gun 20 is instead moved with respect to the stationary substrate 12. The plasma gun 20 may be moved by any of a wide range of robotic manipulator systems that are well-known in the art and readily commercially available. The substrate support system 38 may also be provided with a cooling system 40 to prevent the substrate 12 from becoming overheated during long-duration thermal spray deposition processes.

The substrate support system 38 may comprise any of a wide range of devices well known in the art that are capable of moving in two directions (e.g., the X and Y directions). However, since such devices are well-known in the art and could be easily provided by persons having ordinary skill in the art after having become familiar with the teachings of the present invention, the substrate support system 38 and cooling system 40 that may be utilized in one preferred embodiment will not be described in further detail herein.

The lightweight armor system 10 may be fabricated according to the following process. The first step in the process is to select a suitable substrate 12 and mount it to the substrate support system 38. See FIG. 4. As was mentioned above, the substrate support system 38 is moveable in the X and Y directions (FIG. 3) so that the substrate 12 may be moved during the coating process to provide improved coating uniformity. In most cases, it will be necessary, or at least desirable, to first clean and prime the front surface 42 of the substrate 12 to ensure better adhesion of the graded metal matrix composite layer 14. The surface 42 of the substrate 12 may be cleaned by solvents, or alternatively, may be cleaned by blasting the surface 42 with a suitable abrasive material. By way of example, in one embodiment the front surface 42 of the substrate 12 may be cleaned by blasting it with #38 alumina grit. The abrasive alumina grit removes any residual oil and foreign material and slightly roughens the surface 42 of the substrate 12.

Once the grit blasting process is complete, the front surface 42 of substrate 12 may be primed by depositing thereon a thin primer layer or bond coat 44 (FIG. 2). The bond coat 44 utilized in one preferred embodiment may comprise a nickel aluminum alloy, although other metals and metal alloys may also be used, as was described above. The primer layer or bond coat 44 may be deposited by thermal spray deposition according to the process parameters recommended by the manufacturer of the thermal spray gun (e.g., Miller Thermal, Inc., of Appleton, Wis.). The thickness 54 (FIG. 2) of the bond coat 44 in one preferred embodiment is about 0.003 inches, although other thicknesses may be used, as discussed above. Alternatively, other types of coating processes, such as sputtering, may be used to deposit the bond coat 44.

After the front surface 42 of the substrate 12 has been cleaned and primed, as described above, the first cermet layer 18 (FIG. 2) comprising the graded metal matrix composite layer 14 may be deposited on the bond coat 44. Generally speaking, it will be desirable to pre-heat the substrate 12 before the first cermet layer 18 is deposited. We have found that good results can be obtained if the substrate 12 is pre-heated to temperatures in the range of about 200° C. to about 400° C. (about 300° C. preferred). In the embodiment shown and described herein, the substrate 12 may be suitably pre-heated by the thermal spray deposition process that is used to deposit the bond coat 44. Alternatively, the substrate may be pre-heated by turning off the material feed to the thermal spray gun 20 and thereafter using the barren plasma jet 32 to pre-heat the substrate 12. In any event, once the substrate 12 has been pre-heated to the proper temperature, the first cermet layer 18 may be applied.

As was described above, the first cermet layer 18 should comprise a relatively high percentage (e.g., about 90% on a volume basis) of the metal matrix material and a relatively low percentage (e.g., about 10% on a volume basis) of ceramic material. Such a graded composition may be achieved by pre-mixing the appropriate proportions of metal and ceramic powder and then by loading the mixture into the first hopper 28 connected to the thermal spray gun 20. For example, in the embodiment shown and described herein, a mixture comprising about 90% by volume of aluminum powder and about 10% by volume alumina ($Al_2O_3$) powder may be loaded into the first hopper 28.

Any of a wide range of commercially available powders suitable for thermal spray deposition may be used for the aluminum and alumina powders. For example, the alumina powder may comprise any of a wide range of alumina powders available from Sulzer-Metco Corp. of Westbury, N.Y., such as Metco 105 (particle size range: 15–53 microns); M-105SFP (particle size range: 15–25 microns); and M-54 (particle size range: 5–25 microns). The aluminum powder may comprise any of a wide range of aluminum powders available from Praxair Thermal Spray Systems of Appleton, Wis., such as AI-1010 (particle size range: 15–45 microns); and AI-1020 (particle size range: 45–90 microns).

Before the first cermet layer 18 is deposited, the substrate support system 38 should be activated to continually move the substrate 12 attached thereto along the X and Y directions to assure uniform film thickness. In one preferred embodiment, the substrate support system 38 moves along the X direction at a rate in the range of about 1 to about 24 inches per second (in/sec.) (14–16 in/sec. preferred) with a Y-pitch in the range of about 0.001 to about 1.0 inches (0.10–0.15 inches preferred). As used herein, the term "Y-pitch" refers to a vertical movement of the substrate after the completion of each horizontal sweep. The stand-off distance 70 (FIG. 4) between the gun 20 and the face 42 of the substrate 12 may be in the range of about 2 to about 4 inches (about 2.5 inches preferred). The mixture may then be deposited onto the bond coat 44 of the substrate 12 by the thermal spray gun 20.

The second cermet layer 18 may be deposited in essentially the same way as the first cermet layer 18, except that the material comprising the second cermet layer 18 will comprise a somewhat lesser percentage (by volume) of aluminum powder (e.g., about 80%) and a somewhat greater percentage of alumina powder (e.g., 20%). A powder mixture comprising the foregoing volume percentage ratios may be premixed and loaded into the second hopper 30 connected to the thermal spray gun 20. Accordingly, the second cermet layer 18 may be deposited immediately following the deposition of the first cermet layer 18 by simply changing the hopper from which the material is drawn, e.g., by changing the powder feed from hopper 28 to hopper 30.

The subsequent cermet layers 18 may be deposited in essentially the same manner as the first two cermet layers 18 just described (i.e., in groups of two cermet layers 18 in succession) by providing the appropriate powder mixtures to the hoppers 28 and 30. In one preferred embodiment, the final (i.e., outermost) cermet layer 18 may comprise a mixture of about 90% alumina and about 10% aluminum by volume.

After the final cermet layer 18 comprising the graded metal matrix composite layer 14 has been deposited on the substrate 12, the ceramic impact layer 16 may be affixed to the graded metal Matrix composite layer 14. By way of example, in one preferred embodiment, the ceramic impact layer 16 comprises a substantially pure alumina plate or "tile" and may be affixed to the graded metal matrix composite layer 14 by any of a wide range of suitable adhesives (FIG. 2), such as by a polyurethane adhesive 46.

EXAMPLE

A lightweight armor system 10 according to the present invention was manufactured in accordance with the following material specifications and process parameters:

| | |
|---|---|
| Substrate: | 6061T6 aluminum, 6" × 4" × 0.25"; |
| Bond Coat: | Nickel-aluminum, 0.003" thick; |
| Alumina Powder: | Metco 105 (15–53 microns); |
| Aluminum Powder: | AI-1010 (15–45 microns); |
| Cermet Layer Thickness: | 0.010" (per layer); |
| Number of Cermet Layers: | 9 |
| Impact Layer: | Alumina, 6" × 4" × 0.25"; |
| Substrate Movement: | X-rate: 15 in/sec.; Y-pitch 0.125"; |
| Total Process Gas Flow Rate: | 150–180 Cu.Ft./Hr. |

| Cermet Layer | Layer Composition | Argon:Helium | Power |
|---|---|---|---|
| 1 | 10% $Al_2O_3$ + 90% Al | 50:50 | 42.0 kW |
| 2 | 20% $Al_2O_3$ + 80% Al | 50:50 | 42.0 kW |
| 3 | 30% $Al_2O_3$ + 70% Al | 50:50 | 42.0 kW |
| 4 | 40% $Al_2O_3$ + 60% Al | 50:75 | 43.7 kW |
| 5 | 50% $Al_2O_3$ + 50% Al | 50:75 | 43.7 kW |
| 6 | 60% $Al_2O_3$ + 40% Al | 50:75 | 43.7 kW |
| 7 | 70% $Al_2O_3$ + 30% Al | 50:75 | 43.7 kW |

-continued

| Cermet Layer | Layer Composition | Argon:Helium | Power |
|---|---|---|---|
| 8 | 80% $Al_2O_3$ + 20% Al | 50:100 | 45.3 kW |
| 9 | 90% $Al_2O_3$ + 10% Al | 50:100 | 45.3 kW |

Subsequent ballistic testing demonstrated that the lightweight armor system 10 produced in accordance with the foregoing material specifications and process parameters successively stopped a 30 caliber armor piercing bullet (type 0.30–06 APM2) fired at the lightweight armor system 10 with a muzzle velocity of about 2900 feet per second from a distance of about twenty (20) feet.

It is contemplated that the inventive concepts herein described may be variously otherwise embodied and it is intended that the appended claims be construed to include alternative embodiments of the invention except insofar as limited by the prior art.

We claim:

1. A process for producing an armor system, comprising:

depositing by thermal spray deposition a graded metal matrix composite layer on a substrate, the graded metal matrix composite layer comprising an increasing volume fraction of ceramic particles imbedded in a decreasing volume fraction of a metal matrix with increasing thickness of the graded metal matrix composite layer; and affixing a ceramic impact layer to said graded metal matrix composite layer, wherein the volume fraction of ceramic particles in the graded metal matrix composite layer increases from about 10% at the substrate to about 90% at an interface between the graded metal matrix composite layer and the ceramic impact layer.

2. The process of claim 1, wherein the step of depositing the graded metal matrix composite layer comprises:

depositing by thermal spray deposition a first cermet layer on the substrate, the first cermet layer having a first volume fraction of ceramic particles and a first volume fraction of the metal matrix; and depositing by thermal spray deposition a second cermet layer on the first cermet layer, the second cermet layer having a second volume fraction of ceramic particles and a second volume fraction of the metal matrix, the second volume fraction of ceramic particles in the second cermet layer being greater than the first volume fraction of ceramic particles in the first cermet layer.

3. The process of claim 2, further comprising:

depositing by thermal spray deposition a plurality of cermet layers on the second cermet layer, wherein each successive cermet layer has a greater volume fraction of ceramic particles than a previous cermet layer.

4. The process of claim 3, further comprising:

continuously moving the substrate with respect to a thermal spray gun while the plurality of cermet layers are being deposited by the thermal spray gun.

5. The process of claim 1, further comprising:

depositing a primer layer on the substrate before depositing the graded metal matrix composite layer.

6. The process of claim 5, wherein the primer layer is deposited by thermal spray deposition.

7. The process of claim 5, further comprising:

cleaning a deposition surface of the substrate before depositing the primer layer on the substrate.

8. The process of claim 7, wherein the step of cleaning the deposition surface of the substrate comprises blasting the deposition surface of the substrate with a stream of an abrasive material.

9. The process of claim 1, further comprising the step of pre-heating the substrate before depositing the graded metal matrix composite layer on the substrate.

10. The process of claim 1, wherein the volume fraction of the metal matrix decreases from about 90% at the substrate to about 10% at an interface between the graded metal matrix composite layer and the ceramic impact layer.

11. An armor system, comprising:

a substrate;

a graded metal matrix composite layer formed on the substrate by thermal spray deposition, the graded metal matrix composite layer comprising an increasing volume fraction of ceramic particles imbedded in a decreasing volume fraction of a metal matrix as a function of a thickness of the graded metal matrix composite layer; and a ceramic impact layer affixed to said graded metal matrix composite layer, wherein the volume fraction of ceramic particles in the graded metal matrix composite layer increases from about 10% at the substrate to about 90% at an interface between the graded metal matrix composite layer and the ceramic impact layer.

12. The armor system of claim 11, further comprising a primer layer deposited on said substrate between said substrate and said graded metal matrix composite layer.

13. The armor system of claim 12, wherein said primer layer comprises a mixture of nickel and aluminum.

14. The armor system of claim 13, wherein said nickel and aluminum primer layer is deposited on the substrate by thermal spray deposition.

15. The armor system of claim 11, wherein the ceramic particles comprise alumina.

16. The armor system of claim 11, wherein the metal matrix comprises aluminum.

17. The armor system of claim 11, wherein the substrate comprises aluminum.

18. The armor system of claim 11, wherein said ceramic impact layer comprises alumina.

19. The armor system of claim 11, wherein the volume fraction of the metal matrix decreases from about 90% at the substrate to about 10% at an interface between the graded metal matrix composite layer and the ceramic impact layer.

20. An armor system, comprising:

a substrate;

a graded metal matrix composite layer formed on the substrate by depositing by thermal spray deposition a plurality of cermet layers on the substrate, wherein each successive cermet layer has a greater volume fraction of ceramic particles than a previous cermet layer so that the volume fraction of each successive cermet layer increases from a volume fraction of about 10% in a cermet layer deposited on the substrate to a volume fraction of about 90% in an outer cermet layer comprising said graded metal matrix composite layer; and a ceramic impact layer affixed to said graded metal matrix composite layer.

21. An armor system fabricated in accordance with the process of claim 1.

22. The armor system of claim 20, wherein each of the plurality of cermet layers has a thickness in the range of about 0.010 inches to about 0.050 inches.

23. The armor system of claim 20, wherein the plurality of cermet layers comprises at least four.

24. An armor system, comprising:

a substrate;

a graded metal matrix composite layer formed on the substrate by thermal spray deposition, the graded metal matrix composite layer comprising a decreasing volume fraction of a metal material imbedded in an increasing volume fraction of a ceramic material as a function of a thickness of the graded metal matrix composite layer; and a ceramic impact layer affixed to said graded metal matrix composite layer, wherein the volume fraction of the metal material decreases from about 90% at the substrate to about 10% at an interface between the graded metal matrix composite layer and the ceramic impact layer.

25. A process for producing an armor system, comprising:

providing a substrate;

providing a supply of finely divided ceramic particles;

providing a supply of finely divided metallic particles;

mixing together portions of said ceramic and metallic particles to produce a first mixture having about 10 volume percent ceramic particles and about 90 volume percent metallic particles;

depositing by thermal spray deposition the first mixture on said substrate to form a first cermet layer, the first cermet layer having a first thickness;

mixing together additional portions of said ceramic and metallic particles to produce a second mixture having a greater volume percent of ceramic particles than said first mixture;

depositing by thermal spray deposition the second mixture on said first cermet layer to form a second cermet layer, said second cermet layer having a second thickness;

mixing together additional portions of said ceramic and metallic particles to produce a third mixture having a greater volume percent of ceramic particles than said second mixture;

depositing by thermal spray deposition the third mixture on said second cermet layer to form a third cermet layer, the third cermet layer having a third thickness;

mixing together additional portions of said ceramic and metallic particles to produce a fourth mixture having about 90 volume percent ceramic particles and about 10 volume percent metallic particles;

depositing by thermal spray deposition the fourth mixture on said third cermet layer to form a fourth cermet layer, the fourth cermet layer having a fourth thickness; and affixing a ceramic impact layer to said fourth cermet layer.

26. The process of claim 25, further comprising:

mixing together additional portions of said ceramic and metallic particles to produce a plurality of intermediate mixtures having a greater volume percent of ceramic particles than a previous intermediate mixture; and depositing by thermal spray deposition in a successive manner the plurality of intermediate mixtures on said third cermet layer to form a plurality of successive cermet layers, each of said plurality of successive cermet layers having a greater volume fraction of ceramic particles than a previous cermet layer.

27. The process of claim 26, wherein said plurality of success cermet layers comprises five so that said armor system comprises nine cermet layers.

28. The process of claim 25, wherein each of said first, second, third, and fourth thicknesses is in the range of about 0.010 inches to about 0.050 inches.

29. The process of claim 25, wherein said supply of finely divided ceramic particles comprises alumina particles having sizes in the range of about 5 microns to about 53 microns.

30. The process of claim 25, wherein said supply of finely divided metallic particles comprises aluminum particles having sizes in the range of about 15 microns to about 90 microns.

* * * * *